US007059019B1

(12) United States Patent
Klingler

(10) Patent No.: US 7,059,019 B1
(45) Date of Patent: Jun. 13, 2006

(54) LOCKING DEVICE TO PREVENT DOOR REMOVAL

(76) Inventor: Gregory Lee Klingler, 824 E. Iowa Ave., Denver, CO (US) 80210

( * ) Notice: Subject to any disclaimer, the term of this patent is extended or adjusted under 35 U.S.C. 154(b) by 145 days.

(21) Appl. No.: 10/710,218

(22) Filed: Jun. 26, 2004

(51) Int. Cl.
*E05D 5/12* (2006.01)

(52) U.S. Cl. ..... 16/319; 16/261; 16/380; 70/14; 70/57; 70/230

(58) Field of Classification Search ..... 16/261, 16/262, 319, 380, 382; 70/14, 57, 229, 230; 292/DIG. 17
See application file for complete search history.

(56) References Cited

U.S. PATENT DOCUMENTS 3,206,793 A * 9/1965 Silverberg ..... 16/223
3,811,150 A * 5/1974 Chalmers ..... 16/352
4,122,693 A * 10/1978 Barr ..... 70/56
4,459,832 A * 7/1984 Avrea et al. ..... 70/14
5,337,453 A * 8/1994 Bargesser ..... 16/380
5,487,288 A * 1/1996 Frantz ..... 70/259
6,202,453 B1 * 3/2001 Disher et al. ..... 70/14
6,546,766 B1 4/2003 Klingler ..... 70/230
6,981,750 B1 * 1/2006 Krampotich ..... 312/223.1

* cited by examiner

*Primary Examiner*—Chuck Y. Mah
*Assistant Examiner*—Michael J. Kyle

(57) ABSTRACT

A Locking Device To Prevent Door Removal (10) is provided to prevent theft of a type of door having a hinge pin fixedly attached to the door and a hinge bracket bolted to the door frame housing with bolt holes extending into the door frame housing. The device replaces one of the standard bolts, used to secure the hinge bracket, with an Elongated Bolt (12). A Blocking Piece (20) with a Blocking Piece Through-Hole (38) is positioned over the Elongated Bolt (12) and locked in place with a Padlock (42). The Shackle (40) of the Padlock (42) extends through a Bolt Through-Hole (18) in the Elongated Bolt (12). The Blocking Piece (20) blocks the hinge pin from being lifted out of the hinge sleeve. The Padlock (42) both holds the Blocking Piece (20) against movement and prevents the Elongated Bolt (12) from being removed.

4 Claims, 7 Drawing Sheets

LOCKING DEVICE TO PREVENT DOOR REMOVAL

BACKGROUND OF INVENTION

This invention pertains to locking device that prevents the removal of a door from the door frame to which it is attached.

Most locks for doors are intended to prevent doors from being opened. These types of door locks serve the purpose of securing the items contained within the enclosed space behind the locked door. The subject invention pertains to a different type of door lock. The door lock of the subject invention prevents the door itself from being removed from the door frame to which it is attached. The impetus for the development of the subject invention was the need for a lock to secure the doors of a jeep Wrangler vehicle. Normally, Jeep Wrangler vehicle doors can be easily removed from the vehicle. Some Wrangler doors may be removed simply by lifting the door thus causing the door's hinge pin to come out of the hinge pin sleeve. Other Wrangler doors may be removed simply by removing one or two nuts prior to lifting the door to remove the hinge pin from the hinge pin sleeve.

Wrangler doors are often damaged during the off-roading activities common for these vehicles. Since the demand for replacement Wrangler doors is high, and Wrangler doors can easily be removed from the vehicle, these doors are often subject to theft. This invention prevents the theft of certain types of Jeep Wrangler doors. The application for the subject invention is not limited, however, to Jeep Wranglers. The subject invention will work on any door with certain characteristics found on the door of the Jeep Wrangler. The subject invention is intended for any application in which a door has a hinge pin fixedly attached to the door and a hinge bracket with a hinge pin sleeve bolted to the door support frame, the bolts connecting the hinge bracket to the door support frame being held in place by threaded bolt holes contained within the door support frame itself.

Since the present invention serves the need of a specialty market, the prior art is quite limited. One commercial device, the Security Door Locker manufactured by the Tuffy company of Cortez, Colo., locks Jeep Wrangler vehicle doors onto the vehicle. The Tuffy product requires a substantial amount of installation time since installation entails removing a nut that is located in a difficult-to-access area behind the dash of the vehicle. Furthermore, the Tuffy product is bolted onto the vehicle in a manner such that it can be removed with standard tools even when in the locked configuration. The Tuffy product can therefore be rendered ineffective simply be removing it with standard tools. The Tuffy product is apparently intended only for the cases in which a would-be thief acts on impulse without the tools or time to remove the lock. U.S. Pat. No. 6,546,766, to Klingler, describes a Lock Nut that is highly effective for securing certain types of Wrangler doors. Klingler's Lock Nut is effective, easy to install and, unlike the Tuffy product, cannot be removed without unlocking the device. Klingler's Lock Nut, however, is only effective for those Wrangler vehicle doors containing hinge pins with threaded ends.

The subject invention improves upon the prior art by offering a device that is quick and easy to install; is effective on doors with either threaded or unthreaded hinge pins, and cannot be removed with standard tools when in the locked configuration.

The prior art devices described above do not disclose, teach or illustrate the unique structure, function and advantage of the subject Locking Device To Prevent Door Removal.

SUMMARY OF INVENTION

The essence of the present invention is an improved locking device to prevent the removal of a door. As opposed to any of the prior art devices, the subject invention is quick and easy to install, effective on doors with either threaded or unthreaded hinge pins, and cannot be removed with standard tools when in the locked configuration.

It is a primary object of the present invention to provide a device that is highly effective in securing a door onto its door frame, thus preventing theft of the door.

Another object is that the device is both quick and easy to install.

Still another object is that the device is effective in securing doors with either threaded or unthreaded hinge pins.

Still another object is that, once installed and locked, the device cannot be removed with standard tools. Although any lock can be removed or rendered ineffective given sufficient time and tools, removal or incapacitation of the subject invention would require cutting or grinding tools as opposed to standard wrenches and the like.

Still another object is that, when in the unlocked configuration, the device allows for quick removal of the door.

Still another object is that the device is both small and simple in design, thus yielding relatively low manufacturing costs.

These and other objects of the subject invention will become apparent to those familiar with the different types of locking devices when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

DETAILED DESCRIPTION

Figure 1:
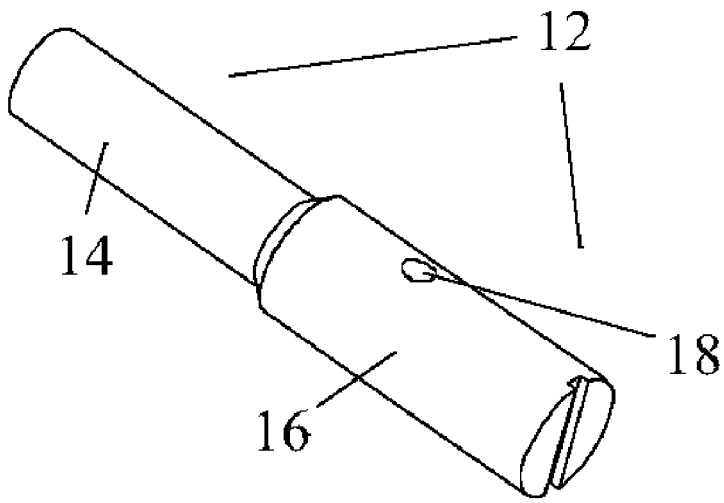
FIG. 1 presents a perspective view of an Elongated Bolt which replaces one of the standard bolts used to attach a hinge bracket to the door frame housing.
Figure 2:
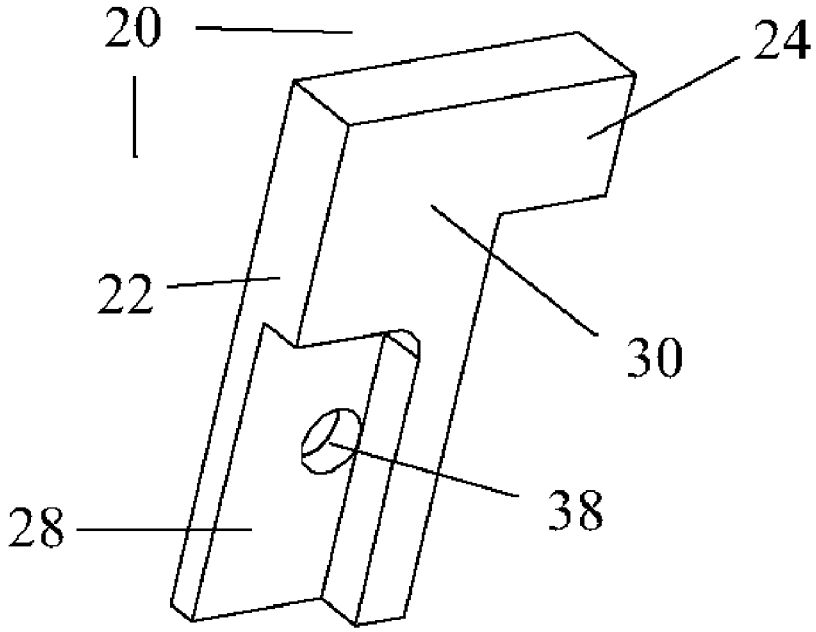
FIG. 2 presents a perspective view of a Blocking Piece which acts to block a hinge pin from being lifted from its hinge sleeve.
Figure 3:
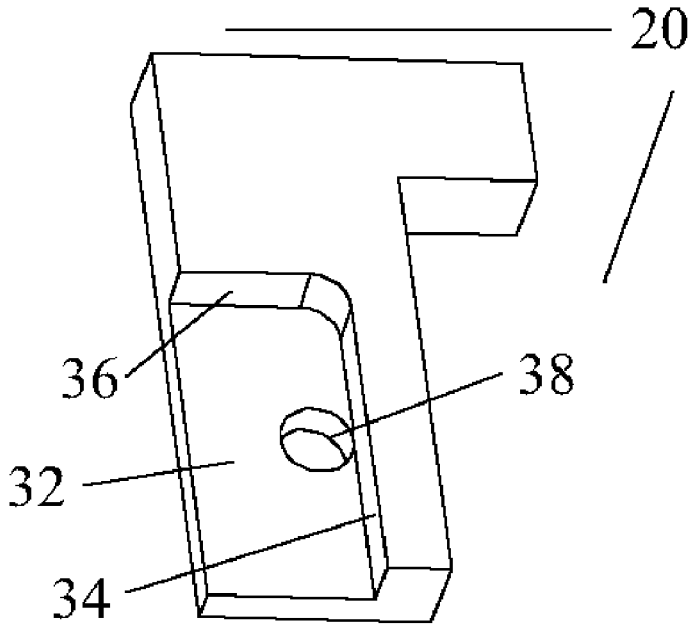
FIGS. 3 and 4 present additional perspective views of the Blocking Piece.
Figure 4:
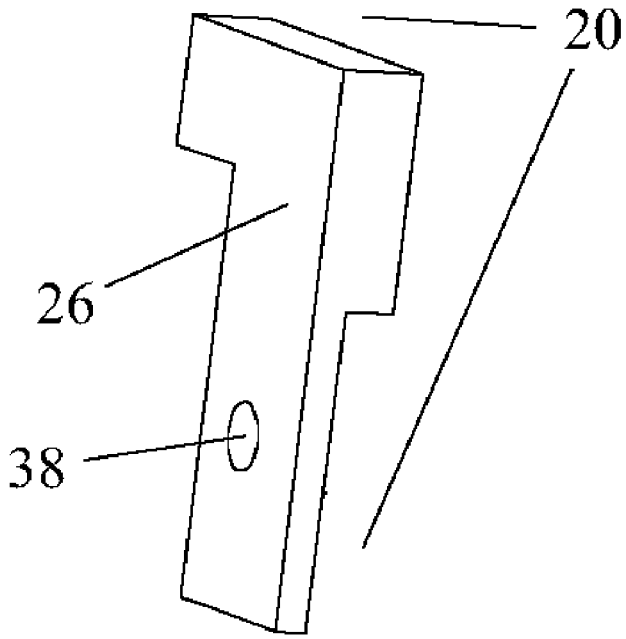
Figure 5:
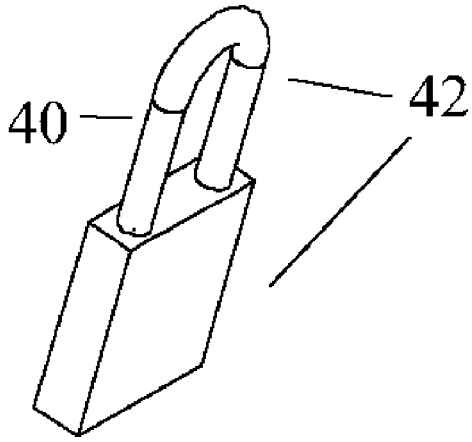
FIG. 5 presents a Padlock used to secure both the Elongated Bolt and the Blocking Piece.
Figure 6:
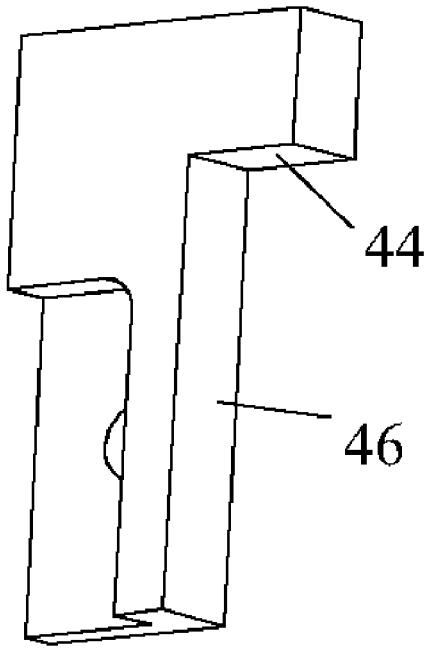
FIG. 6 presents another perspective view of the Blocking Piece, illustrating additional features.
Figure 7:
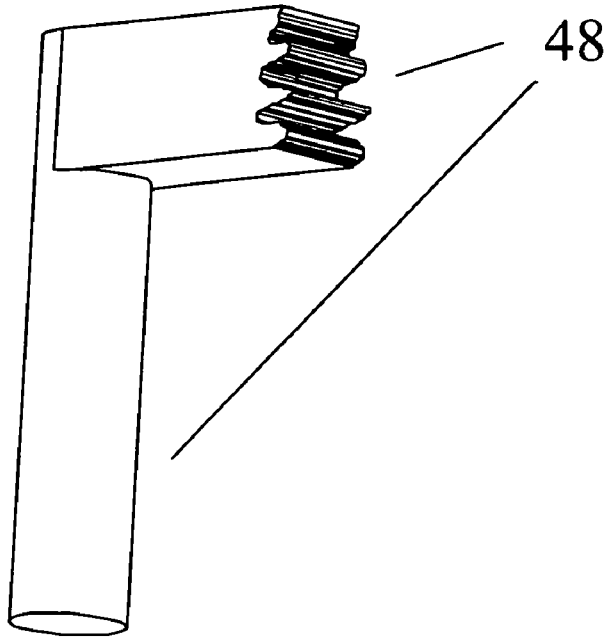
Fig. 7 Prior Art
FIG. 7 presents a perspective view of a hinge pin that is attached to a door (not shown).
Figure 8:
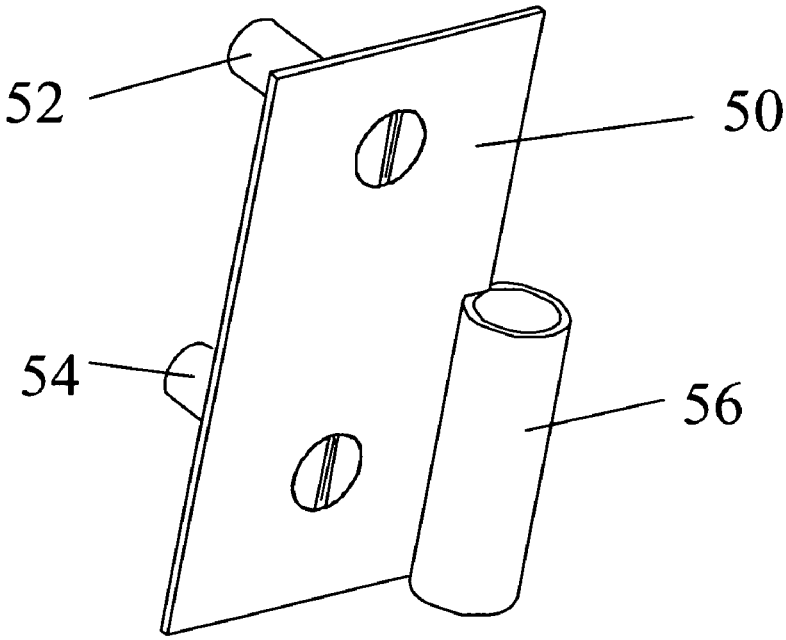
Fig. 8 Prior Art
FIG. 8 presents a perspective view of the hinge bracket and hinge sleeve as well as the bolts used to attach the hinge bracket to a door frame housing (not shown).
Figure 9:
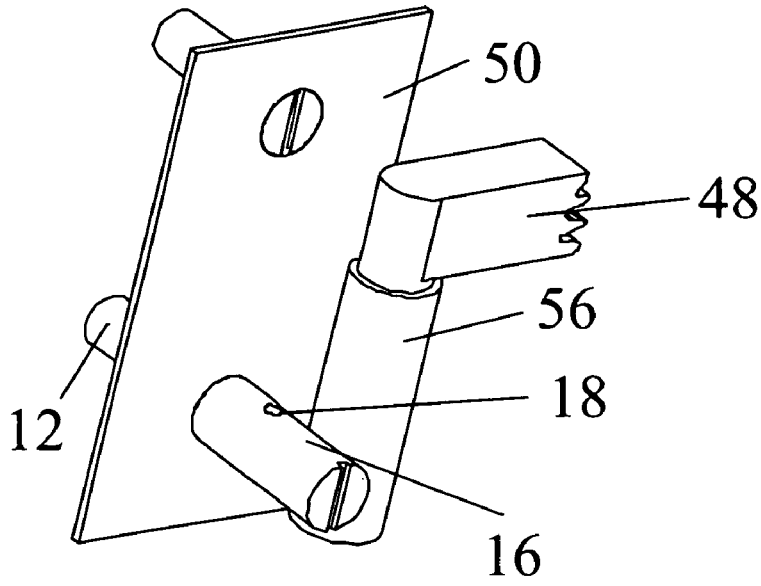
FIG. 9 illustrates the replacement of a standard bolt with the Elongated Bolt.
Figure 10:
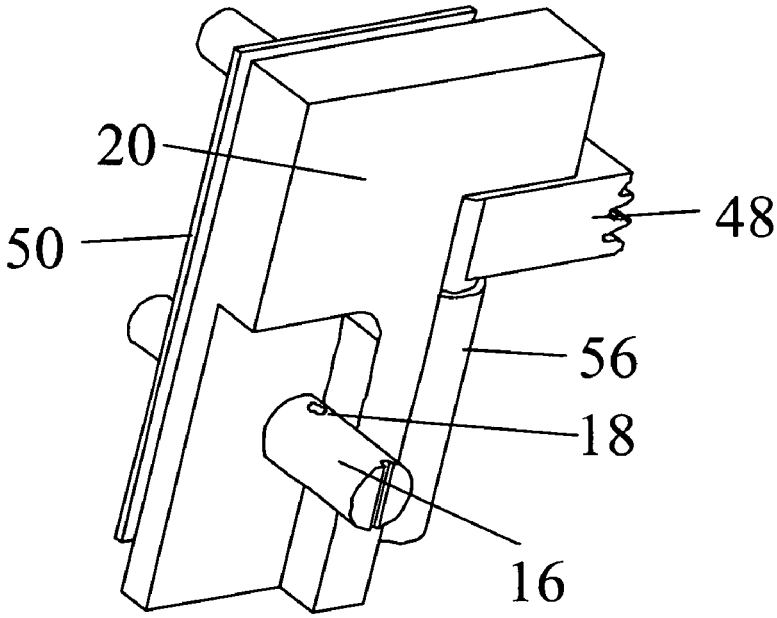
FIG. 10 illustrates the placement of the Blocking Piece on the Elongated Bolt.
Figure 11:
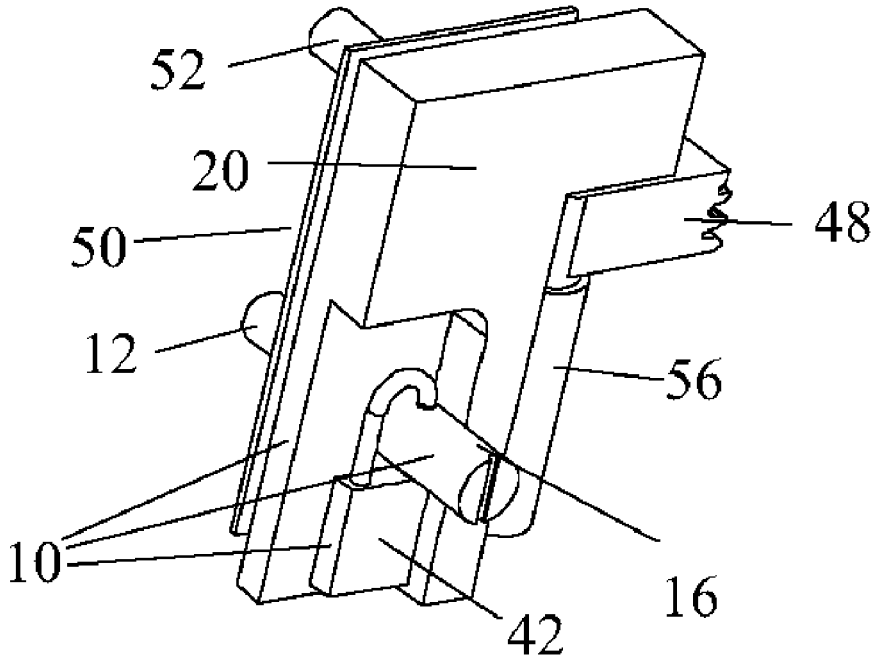
FIG. 11 presents the entire subject invention in its locked configuration.
Figure 12:
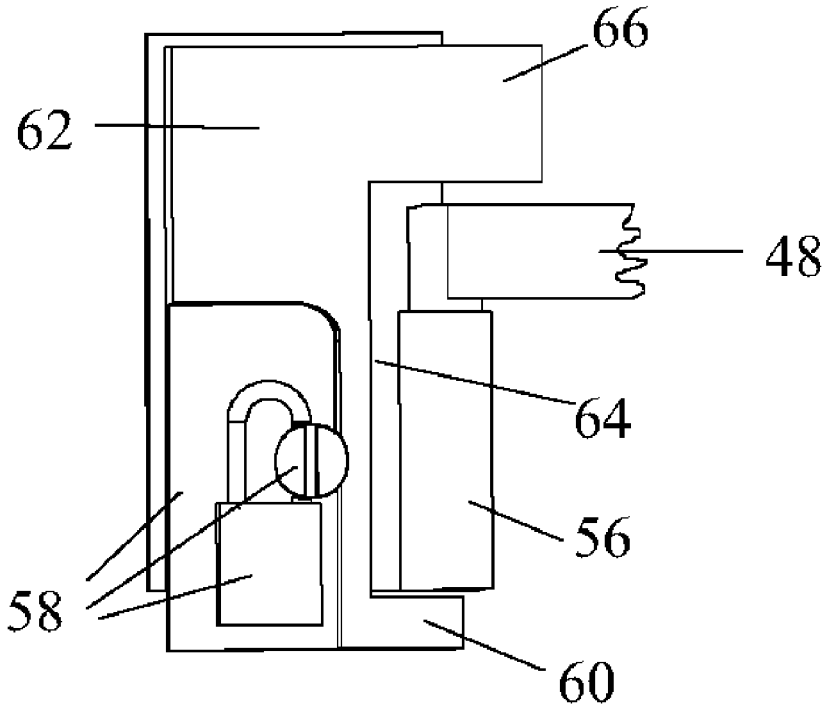
FIG. 12 presents an Alternate Blocking Piece.
Figure 13:
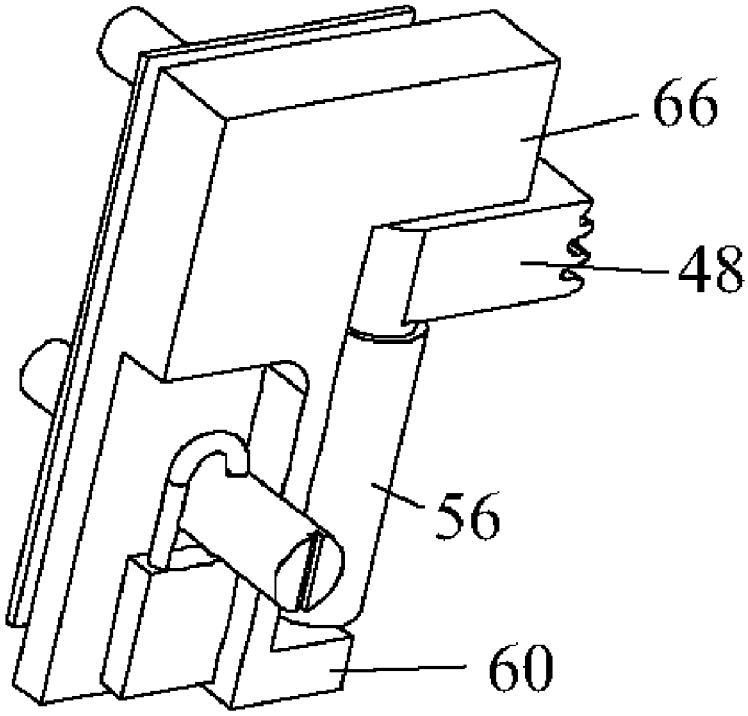
FIG. 13 presents the entire subject invention, with the Alternate Blocking Piece, in its locked configuration.

In a Locking Device To Prevent Door Removal (10) an Elongated Bolt (12) contains a Threaded Section (14) [threads not shown] and a Cylindrical Extension Section (16). The Cylindrical Extension Section (16) has a Bolt Through-Hole (18) passing through the Cylindrical Extension Section (16).

A Blocking Piece (20), generally in the shape of an inverted "L", has a Body (22) and a Blocking Arm (24). The Blocking Arm (24) extends horizontally outward from the top portion of the Body (22). The Blocking Piece (20) has a Back Face (26), an Inner Front Face (28), and an Outer Front Face (30). The Blocking Piece (20) is thinner in the area of the Inner Front Face (28) than in the area of the Outer Front Face (30) thus forming a Recessed Area (32) with a Recess Side Face (34) and a Recess Top Face (36). A Blocking Piece Through-Hole (38) passes through the Body (22) directly behind the Recessed Area (32) creating an opening in the Inner Front Face (28).

The Bolt Through-Hole (18) is dimensioned so as to allow passage of a Shackle (40) of a Padlock (42). The Blocking Piece Through-Hole (38) is dimensioned so as to allow passage of the Cylindrical Extension Section (16).

The Blocking Arm (24) has a Blocking Arm Bottom Face (44). The Body (22) has a Body Side Face (46).

Objects which are part of the door assembly to which the subject invention applies, but which are not part of the subject invention, include a Hinge Pin (48) fixedly attached to a door (not shown); a Hinge Bracket (50) attached to a door housing (not shown) by an Upper Bolt (52) and a Lower Bolt (54); and a Hinge Sleeve (56) attached to the Hinge Bracket (50). The Upper Bolt (52) and Lower Bolt (54) are attached by way of threaded receiving holes (not shown) within the door frame housing (not shown). When the door (not shown) is in place, the Hinge Pin (48) resides within the Hinge Sleeve (56).

In order to attach the device, the Lower Bolt (54) is removed and replaced with the Elongated Bolt (12). The Blocking Piece (20) is then positioned such that the Back Face (26) lies against the Hinge Bracket (50) with the Cylindrical Extension Section (16) passing through the Blocking Piece Through-Hole (38) such that the end of the Cylindrical Extension Section (16) is beyond the Inner Front Face (28), the Bolt Through-Hole (18) lies within the Recessed Area (32), the Body Side Face (46) lies against the Hinge Sleeve (56), and the Blocking Arm Bottom Face (44) lies slightly above the top of the Hinge Pin (48). Once the Blocking Piece (20) has been positioned, the Shackle (40) of the Padlock (42) is inserted through the Bolt Through-Hole (18) and the Padlock (42) is locked.

The subject invention prevents removal of the door (not shown) because the Blocking Arm (24) blocks the removal of the Hinge Pin (48) from the Hinge Sleeve (56). Furthermore, the Blocking Piece (20) cannot be removed unless the Padlock (42) is unlocked and removed. The Blocking Piece (20) is bounded against rearward movement by the Hinge Bracket (50); against forward movement by the Padlock (42); against up, down, or sideways movement by the Cylindrical Extension Section (16); and against rotation about the Cylindrical Extension Section (16) by the Hinge Sleeve (56). The Elongated Bolt (12) cannot be removed while the Padlock (42) is in place because attempted rotation of the Elongated Bolt (12) is blocked when the Padlock (42) contacts the Recess Side Face (34) and/or the Recess Top Face (36). The Padlock (42) therefore serves a dual purpose of both holding the Blocking Piece (20) in place and preventing removal of the Elongated Bolt (12).

Although not a required function of the subject invention, the Blocking Piece (20) also prevents access to the Upper Bolt (52), effectively thwarting attempts to tamper with the Hinge Bracket (50).

In an Alternate Embodiment Locking Device To Prevent Door Removal (58) the components are analogous to the Locking Device To Prevent Door Removal (10) with the exceptions noted hereafter. A Blocking Piece Lower Extended Portion (60) extends outward horizontally from an Alternate Embodiment Blocking Piece (62) and, in use, resides just below the Hinge Sleeve (56). An Alternate Body Side Face (64) need not lie in close proximity to the Hinge Sleeve (56). In this alternate embodiment, it is the Blocking Piece Lower Extended Portion (60) that prevents rotation of the device around the Cylindrical Extension Section (16) rather than the Alternate Body Side Face (64). Attempts to rotate the device in a counter-clockwise direction cause the Blocking Piece Lower Extended Portion (60) to contact the bottom of the Hinge Sleeve (56). Attempts to rotate the device in a clockwise fashion cause an Alternate Blocking Arm (66) to contact the top of the Hinge Pin (48).

Thus the reader will see that the subject Locking Device To Prevent Door Removal provides a highly effective solution to the theft of certain types of doors. The subject invention is simple in design, of low cost, highly effective, and quick and easy to install.

While the above description contains many specifics, these should not be construed as limitations on the scope of the invention, but rather as exemplification of one embodiment thereof. Each piece described within the aforementioned embodiment could be changed in form in ways that would not affect its function. Accordingly, the scope of the invention should be determined not by the embodiment illustrated, but by the appended claims and their legal equivalents.

The invention claimed is:

1. A locking device to prevent door removal of a door having a hinge pin fixedly attached to said door and a hinge bracket bolted to a door frame housing for said door; said hinge bracket having a hinge sleeve for receipt of said hinge pin; said door frame housing having threaded holes for receipt of bolts used to secure said hinge bracket to said door frame housing; said locking device to prevent door removal comprising:

a) an elongated bolt with a threaded bolt portion, an extended bolt portion, and a lock attachment hole; in use, said elongated bolt replacing one of said bolts used to secure said hinge bracket to said door frame housing, b) a padlock with a shackle, c) a blocking piece with a blocking piece hole, a blocking piece back face, a blocking piece inner front face, and a blocking piece outer front face; said blocking piece hole passing through said blocking piece back face and said blocking piece inner front face; said blocking piece hole being dimensioned so as to receive said extended bolt portion of said elongated bolt; an open space in front of said blocking piece inner front face but behind said blocking piece outer front face forming a recessed area with at least one recessed area wall extending between said blocking piece inner front face and said blocking piece outer front face; said blocking piece further having a blocking piece rotation prevention means; said blocking piece rotation prevention means preventing the ability to rotate said blocking piece with respect to said extended bolt portion; said blocking piece being positioned and dimensioned such that, in use, said blocking piece back face lies against a front face of said hinge bracket, said extended bolt portion passes through said blocking piece hole, said lock attachment hole lies in front of said blocking piece inner front face and within, or near, said recessed area; said recessed area dimensioned so as to allow attachment of said padlock through said lock attachment hole; said recessed area further dimensioned such that said elongated bolt cannot be fully rotated when said padlock is attached to said extended bolt portion due to said padlock contacting said recessed area wall; said blocking piece being unable to rotate with respect to said extended bolt portion due to said blocking piece rotation prevention means; said extended bolt portion preventing up, down, or sideways movement of said blocking piece; said padlock preventing forward movement of said blocking piece, d) a hinge pin blocking arm fixedly attached to said blocking piece and extending outward from said blocking piece, positioned such that, in use, a portion of said hinge pin blocking arm lies above, and in close proximity to, the top of said hinge pin; said hinge pin blocking arm being shaped so as to block upward movement of said hinge pin while not interfering with the required rotational movement of said hinge pin or said door.

2. The device of claim 1 wherein said blocking piece rotation prevention means is comprised of a blocking piece side face; in use, said blocking piece side face being positioned adjacent to said hinge sleeve;

said blocking piece side face contacting said hinge sleeve, thereby preventing further rotation, when one attempts to rotate said blocking piece with respect to said extended bolt portion.

3. The device of claim 1 wherein said blocking piece rotation prevention means is comprised both of said hinge pin blocking arm and a blocking piece lower extended portion; said blocking piece lower extended portion extending outward from a lower portion of said blocking piece; in use, said blocking piece lower extended portion being positioned just below said hinge sleeve; attempted clockwise rotation of said blocking piece with respect to said extended bolt portion causing said hinge pin blocking arm to contact the top of said hinge pin thereby preventing further rotation; attempted counter-clockwise rotation of said blocking piece with respect to said extended bolt portion causing said blocking piece lower extended portion to contact the bottom of said hinge sleeve thereby preventing further rotation.

4. The device of claim 1 wherein said blocking piece is shaped so as to cover one or more of said bolts used to secure said hinge bracket to said door frame housing when said blocking piece is in place; said blocking piece thereby preventing access to one or more of said bolts used to secure said hinge bracket to said door frame housing.

* * * * *